US012280940B2

(12) United States Patent
Hodges

(10) Patent No.: US 12,280,940 B2
(45) Date of Patent: Apr. 22, 2025

(54) PACKAGE

(71) Applicant: British American Tobacco (Investments) Limited, London (GB)

(72) Inventor: Paul Hodges, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 17/633,567

(22) PCT Filed: Jul. 30, 2020

(86) PCT No.: PCT/GB2020/051822

§ 371 (c)(1),
(2) Date: Feb. 7, 2022

(87) PCT Pub. No.: WO2021/028651

PCT Pub. Date: Feb. 18, 2021

(65) Prior Publication Data

US 2022/0289469 A1 Sep. 15, 2022

(30) Foreign Application Priority Data

Aug. 15, 2019 (GB) ..... 1911723

(51) Int. Cl.
*B65D 85/10* (2006.01)

(52) U.S. Cl.
CPC ..... *B65D 85/10564* (2020.05)

(58) Field of Classification Search
CPC ..... B65D 85/10564; B65D 85/1056; B65D 85/10
USPC ..... 206/268
See application file for complete search history.

(56) References Cited

U.S. PATENT DOCUMENTS 5,678,690 A 10/1997 Belvederi et al.
5,725,144 A 3/1998 Stone et al.
6,591,982 B2 7/2003 Focke et al.
2006/0278542 A1* 12/2006 Pham ..... B65D 85/10564 206/268
2012/0000801 A1* 1/2012 Gibson ..... B65D 5/6691 206/268

(Continued)

FOREIGN PATENT DOCUMENTS

CA 2069686 A1 12/1992
DE 102017007130 A1 * 1/2019 ..... B65D 75/5838

(Continued)

OTHER PUBLICATIONS

International Search Report and Written Opinion for Application No. PCT/GB2020/051822, mailed Oct. 30, 2020, 10 pages.

(Continued)

*Primary Examiner* — Rafael A Ortiz
(74) *Attorney, Agent, or Firm* — Husch Blackwell

(57) ABSTRACT

The present disclosure relates to a package for one or more delivery systems. The package includes a container and a lid hingedly connected to the container about a hinge line 5. The package further includes an inner frame comprising a side wall having a portion which extends from the container and which is received in the lid when the lid is closed. The portion of the side wall extending from the container includes at least two regions having different coefficients of friction.

21 Claims, 5 Drawing Sheets

(56) References Cited

U.S. PATENT DOCUMENTS

2018/0134493 A1* 5/2018 Cunningham ..... A47G 23/0216

FOREIGN PATENT DOCUMENTS

| | | | |
|---|---|---|---|
| EP | 0507112 | A2 | 10/1992 |
| EP | 0801010 | A1 | 10/1997 |
| EP | 3251971 | A1 | 12/2017 |
| EP | 3251972 | A1 | 12/2017 |
| GB | 2151212 | A | 7/1985 |
| JP | H05213340 | A | 8/1993 |
| JP | 2012510934 | A | 5/2012 |
| WO | 0149577 | A1 | 7/2001 |
| WO | 2010063569 | A1 | 6/2010 |
| WO | 2013068500 | A1 | 5/2013 |
| WO | 2013145076 | A1 | 10/2013 |
| WO | 2015165999 | A1 | 11/2015 |
| WO | 2016016376 | A1 | 2/2016 |
| WO | 2016139170 | A1 | 9/2016 |

OTHER PUBLICATIONS

"International Preliminary Report on Patentability received for PCT Patent Application No. PCT/GB2020/051822, mailed on Feb. 24, 2022", 8 pages.

"International Preliminary Report on Patentability received for PCT Patent Application No. PCT/GB2020/051823, mailed on Feb. 24, 2022", 8 pages.

"International Search Report and Written Opinion received for PCT Patent Application No. PCT/GB2020/051823, mailed on Oct. 29, 2020", 9 pages.

"Office action received for Canadian Patent Application No. 3150416, mailed on Mar. 3, 2023", 4 pages.

"Office Action received for Russian Patent Application No. 2022103674, mailed on Oct. 10, 2022", 12 pages (6 pages of English Translation and 6 pages of Official Copy).

* cited by examiner

PACKAGE

PRIORITY CLAIM

The present application is a National Phase entry of PCT Application No. PCT/GB2020/051822, filed Jul. 30, 2020, which claims priority from GB Patent Application No. 1911723.3, filed Aug. 15, 2019, each of which is hereby fully incorporated herein by reference.

TECHNICAL FIELD

The present disclosure relates to a package for one or more delivery systems. In particular, the invention relates to a hinge-lid package for delivery systems, such as smoking articles, but is not limited thereto.

BACKGROUND

Hinge-lid packages are known to those skilled in the art and are in widespread use in the tobacco industry for holding delivery systems, such as smoking articles like cigarettes, in a crush resistant manner. Hinge-lid packages are typically produced from cardboard blanks.

However, conventional hinge-lid packages have a tendency to not close properly such that the contents of the package can become soiled by contaminants such as moisture and/or dirt. One option has been to use locking tabs in an attempt to keep the package fully closed. However, the locking tabs themselves can be damaged so that they cannot perform their function and also make the package complex to manufacture.

SUMMARY

According to embodiments of the present disclosure, there is provided a package for one or more delivery systems comprising a container and a lid hingedly connected to the container about a hinge line, and an inner frame comprising a side wall having a portion which extends from the container and which is received in the lid when the lid is closed, wherein said portion of the side wall extending from the container comprises at least two regions having different coefficients of friction.

In an embodiment, the lid may have a side panel that overlaps a corresponding side wall of the inner frame when the lid is closed, and the at least two regions may comprise at least a first region and a second region, and wherein the first region has a lower coefficient of friction than the second region, the regions of the side wall being arranged such that when the lid is rotated towards a closed position, the side panel of the lid slides against the first region of its corresponding side wall before sliding against the second region of its corresponding side wall.

The inner frame may comprise an upper edge, and the first region may be located proximate to the upper edge of the inner frame and the second region is located distal to the upper edge of the inner frame.

In some embodiments, the first region may be located on an upper part of the side wall of the inner frame and the second region may be located on a lower part of the side wall of the inner frame.

In some embodiments, the package may further comprise at least a third region on the inner frame having a different coefficient of friction to the first and second regions, the third region being located between the first and second regions, and wherein at least one of the regions extends from the front wall edge of the side wall towards the rear edge.

At least one of the regions may extend fully across the width of the portion of the side wall which extends from the container between the front wall edge and the rear edge of the side wall.

In an embodiment of the disclosure, at least one of the regions is discrete and comprises peripheral edges which delimit the region, and wherein a peripheral edge of at least one of the regions extends parallel to a bottom wall of the container.

In some embodiments, a peripheral edge of each of the regions on the side wall extends parallel to the bottom wall of the container. In some embodiments, the upper and lower peripheral edges of each of the regions on the side wall extend parallel to the bottom wall of the container.

In some embodiments, at least one of an upper and lower peripheral edge of each region which delimit the regions on the inner frame extend radially from a point which originates at an axis extending along the hinge line.

The side wall of the inner frame may comprise a front wall edge and a rear wall edge, and the first region may be located proximate to the rear edge of the side wall and the second region may be located proximate to the front wall edge of the side wall.

In some embodiments, the first region may be located on a rearward part of the side wall of the inner frame and the second region may be located on a forward part of the side wall of the inner frame.

The package may further comprise at least a third region on the inner frame having a different coefficient of friction to the first and second regions, the third region being located between the first and second regions.

In some embodiments, the container comprises an upper edge and the inner frame comprises an upper edge, and at least one of the regions extends from the upper edge of the container towards the upper edge of the inner frame.

In some embodiments, at least one of the regions extends fully along the length of the portion of the side wall which extends from the container between the upper edge of the container and the upper edge of the inner frame.

At least one of the regions may be discrete and comprise peripheral edges which delimit the region, and a peripheral edge of at least one of the regions may extend parallel to a front wall of the container.

In some embodiments, upper and lower peripheral edges of each of the regions extend parallel to the front wall of the container.

In some embodiments, the coefficient of friction changes gradually between the at least two regions.

At least one of the regions may be formed by a coating on the side wall of the inner frame. In some embodiments, the second region is formed by a coating having a coefficient of friction greater than the coefficient of friction of the side wall of the inner frame. In some embodiments, a first region is formed by a coating having a coefficient of friction less than the coefficient of friction of the side wall of the inner frame.

The lid may comprise at least two regions having different coefficients of friction, and a first region on the lid may overlap the first region on the inner frame and a second region on the lid may overlap the second region on the inner frame when the lid is in its closed position.

BRIEF DESCRIPTION OF THE DRAWINGS

So that the disclosure may be more fully understood, embodiments of the present disclosure will now be described, by way of example only, with reference to the accompanying drawings, in which.

DETAILED DESCRIPTION

As used herein the term "delivery system" is intended to encompass systems that deliver a substance to a user, and includes:

combustible aerosol provision systems, such as cigarettes, cigarillos, cigars, and tobacco pipes or for roll-your-own or for make-your-own cigarettes (whether based on tobacco, tobacco derivatives, expanded tobacco, reconstituted tobacco, tobacco substitutes or other smokeable material);

non-combustible aerosol provision systems that release compounds from an aerosolizable material without combusting the aerosolizable material, such as electronic cigarettes, tobacco heating products, and hybrid systems to generate aerosol using a combination of aerosolizable materials;

articles comprising aerosolizable material and configured to be used within one of these non-combustible aerosol provision systems; and aerosol-free delivery systems, such as lozenges, gums, patches, articles comprising inhalable powders, and smokeless tobacco products such as snus and snuff, which deliver a material to a user without forming an aerosol, wherein the material may or may not comprises nicotine.

According to the present disclosure, a "combustible" aerosol provision system is one where a constituent aerosolizable material of the aerosol provision system (or component thereof) is combusted or burned in order to facilitate delivery to a user.

According to the present disclosure, a "non-combustible" aerosol provision system is one where a constituent aerosolizable material of the aerosol provision system (or component thereof) is not combusted or burned in order to facilitate delivery to a user.

Figure 1:
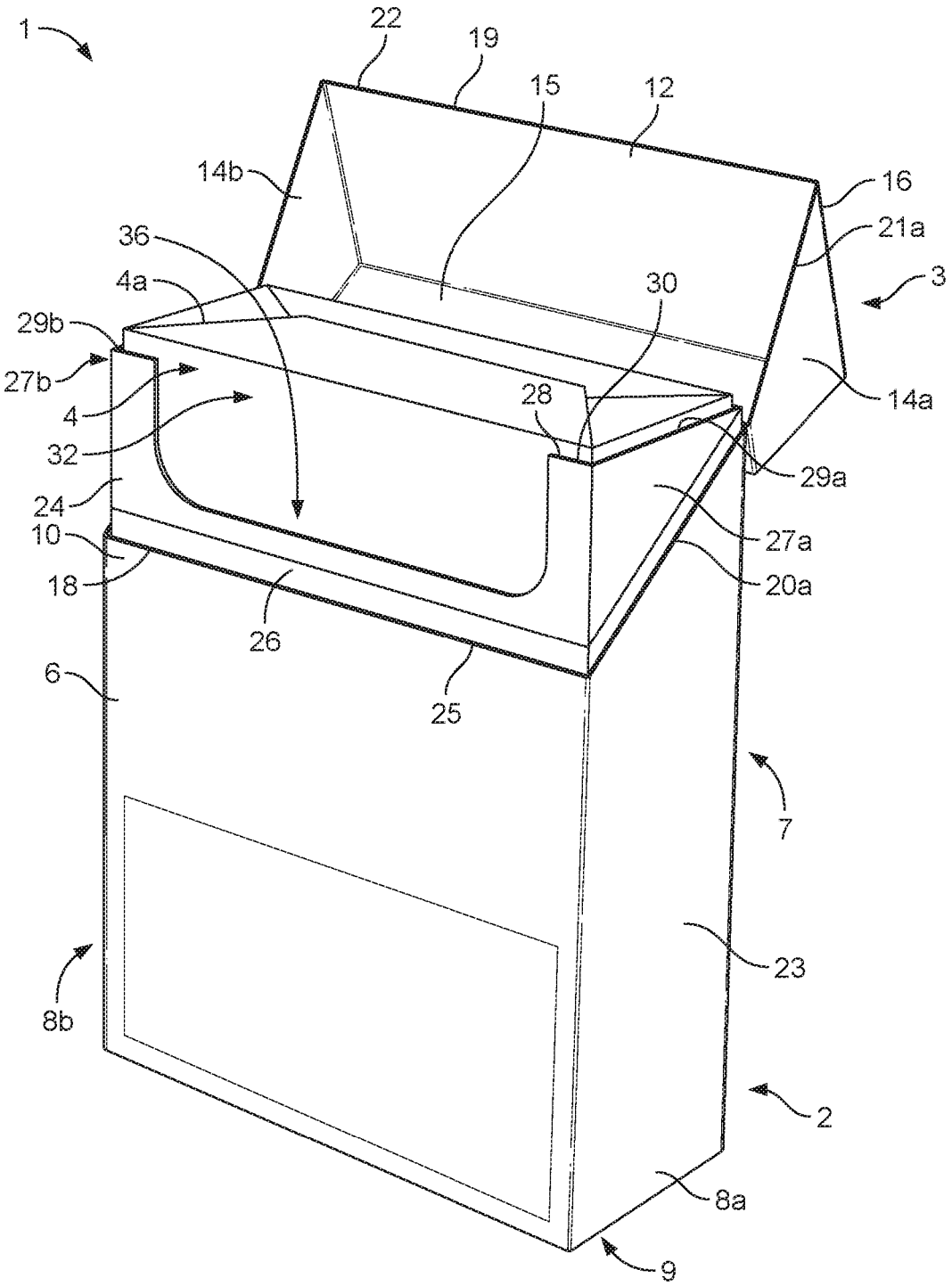
FIG. 1 shows a perspective view of a package of the present disclosure.

Referring to FIG. 1, a package 1 according to the present disclosure is shown. The package 1 comprises a container 2 and a lid 3. The container 2 forms a delivery system receiving space 4 in which delivery systems (wrapped in a bundle 4*a*) such as smoking articles are receivable. The lid 3 is attached to the container 2 along a hinge line 5, shown more clearly in FIG. 3, in order to allow the package 1 to be opened and closed. It will be appreciated that delivery systems in the delivery system receiving space 4 are accessible when the lid 3 is in an open position, and the delivery systems are retained in the delivery system receiving space 4 when the lid 3 is in a closed position, shown in FIG. 3.

The container 2 comprises a container front wall 6 and a container rear wall 7. The container front and rear walls 6, 7 are disposed parallel to but spaced from each other. The container 2 further comprises two opposing container side walls 8*a*, 8*b* which are disposed parallel to but spaced from one another. The two container side walls 8*a*, 8*b* extend between the container front and rear walls 6, 7. The container 2 further comprises a bottom wall 9 which forms a closed end of the container 2. The bottom wall 9 extends from a lower part of the container front, rear, and side walls, 6, 7, 8*a*, 8*b*. An upper end 10 of the container 2 is located opposite the bottom wall 9 and forms an open end of the container 2. The upper end 10 of the container 2 is covered by the lid 3 when the lid 3 is in its closed position. In the present embodiment, the hinge line 5 about which the lid 3 is hinged to the container 2 is formed along a top end of the container rear wall 7.

Figure 3:
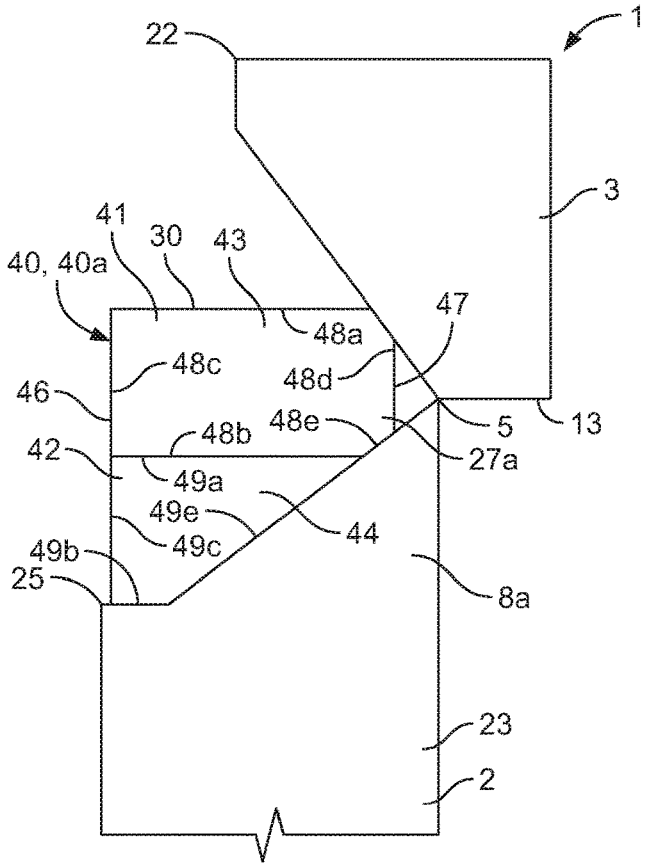
FIG. 3 shows a side view of an embodiment of the present disclosure.

The lid 3 comprises a lid front wall 12 and a lid rear wall 13, shown in FIG. 3. The lid front and rear walls 12, 13 are disposed parallel to but spaced from each other. The lid 3 further comprises two opposing lid side walls 14*a*, 14*b* which are disposed parallel to but spaced from each other. The two lid side walls 14, 14*b* extend between the lid front and rear walls 12, 13. The lid 3 further comprises a top wall 15 which forms a closed end of the lid 3. The top wall 15 extends from an upper part of the lid front, rear, and side walls 12, 13, 14*a*, 14*b*. A lower end 16 of the lid 3 is located opposite the top wall 15 and forms an open end of the lid 3.

When the lid 3 is closed, an upper edge 18 of the container front wall 6 abuts a lower edge 19 of the lid front wall 12 and the upper edges 20*a*, 20*b* of the container side walls 8*a*, 8*b* abut the lower edges 21*a*, 21*b* of the lid side walls 14*a*, 14*b*. A lower edge 22 of the lid 3 is formed by the lower edge 19 of the lid front wall 12 and the lower edges 21*a*, 21*b* of the lid side walls 14*a*, 14*b*. The hinge line 5 is formed where the container rear wall 7 and lid rear wall 13 meet.

The container 2 of the package 1 as described above forms an outer frame 23. The outer frame 23 includes the walls of the container 2 of the package 1 that can be seen when the lid 3 in in its closed position. The package 1 further comprises an inner frame 24. The inner frame 24 also forms a part of the container 2. That is, the container 2 comprises the outer frame 23, as described above, and an inner frame 24, which will be described in more detail hereinafter. The upper edge 18 of the container front wall 6 and the upper edges 20 of the container side walls 8*a*, 8*b* form an upper edge 25 of the outer frame 23 of the container 2.

The inner frame 24 is configured to be placed inside the receiving space 4 proximate to or against the inner surface of the container front wall 6. As illustrated, the inner frame 24 partially extends from the open upper end 10 of the outer frame 23 of the container 2. The inner frame 24 is configured to add strength to a portion of the outer frame 23 in order to protect the delivery systems received in the delivery system receiving space 4.

The inner frame 24 of the container 2 comprises an inner front wall 26. The inner front wall 26 extends from the upper edge 18 of the container front wall 6 and in a plane parallel to the plane in which the container front wall 6 extends. The inner frame 24 of the container 2 further comprises two inner side walls 27*a*, 27*b*. The inner side walls 27*a*, 27*b* extend from the upper edges 20*a*, 20*b* of the container side walls 8*a*, 8*b* and in a plane parallel to the plane in which the container side walls 8*a*, 8*b* extend. That is, the inner front wall 26 extends parallel to the container front wall 6 and the inner side walls 27*a*, 27*b* extend parallel to the container side walls 8*a*, 8*b*.

When the lid 3 is in the closed position, the lid front wall 12 lies substantially adjacent to and overlaps the inner front wall 26 of the container 2, and the two lid side walls 14*a*,

14*b* lie adjacent to and overlap the corresponding inner side walls 27*a*, 27*b* of the container 2. Therefore, the lid 3 fits snuggly over the inner frame 24 when the lid 3 is in its closed position.

The inner front wall 26 of the inner frame 24 comprises an upper edge 28 which is spaced from the upper edge 18 of the container front wall 6 of the outer frame 23 of the container 2. Similarly, the inner side walls 27*a*, 27*b* of the inner frame 24 comprise upper edges 29*a*, 29*b* which are spaced from the upper edges 20 of the container side wall 8*a*, 8*b* of the outer frame 23 of the container 2.

In the present embodiment illustrated in FIG. 1, the upper edge 28 of the inner front wall 26 of the inner frame 24 extends parallel to the upper edge of the container front wall 6 of the outer frame 23 of the container 2. Furthermore, the upper edges 29*a*, 29*b* of the inner side walls 27*a*, 27*b* of the inner frame 24 extend from the upper edge 28 of the inner front wall 26 towards the rear wall 7 of the outer frame 23 of the container 2 parallel to the bottom wall 9 of the container 2.

In the present embodiment, the upper edges 28, 29*a*, 29*b* of the inner frame 24 are located at the same vertical distance from the bottom wall 9 of the outer frame 23 of the container 2. Furthermore, the upper edges 28, 29*a*, 29*b* are all located above the hinge line 5 connecting the lid 3 to the container 2. However, in alternative embodiments, the upper edges of the inner frame 24 may have a different configuration. For example, the upper edges 29*a*, 29*b* of the inner side walls 27*a*, 27*b* may extend parallel to the upper edges 20*a*, 20*b* of the container side walls 8*a*, 8*b* of the outer frame 23 of the container 2 such that at least a part of the upper edges 29*a*, 29*b* of the inner side walls 27*a*, 27*b* are above the upper edge 26 of the inner front wall 26. In one embodiment, each of the upper edges may be completely below the hinge line 5 of the package 1 and/or the edges may be curved, etc.

In one embodiment, a cut-out (not shown) may be formed in the inner front wall 26 of the inner frame 24 so that the upper edge 28 of the front wall 26 of the inner frame 24 is below at least a part of the upper edges 29*a*, 29*b* of the side walls 27*a*, 27*b* of the inner frame 24.

The inner front wall 26 of the inner frame 24 also comprises a recess 32. The recess 32 extends in the inner front wall 26 of the inner frame 24 of the container 2. The recess 32 extends from the upper edge 28 of the inner front wall 26. The recess 32 has a lower edge 34, and side edges 35*a*, 35*b* which extend between the upper edge 26 of the inner front wall 26 and the lower edge 34 of the recess 32. In the present embodiment, the lower edge 34 of the recess 32 extends parallel to, but spaced from the upper edge 28 of the inner front wall 26 of the inner frame 24, and the side edges 35 of the recess 32 extend transverse to the lower edge 34. The edges 34, 35*a*, 35*b* define an opening 36 of the inner frame 24 to the delivery system receiving space 4. Delivery systems are inserted and removed by a user through the opening 36 defined by the edges 34, 35*a*, 35*b* of the inner frame 24.

The lower edge 34 of the recess 32 is spaced from the upper edge 18 of the container front wall 6 of the outer frame 23 of the container 2. The lower edge 34 of the recess 32 is spaced from the upper edge 18 of the container front wall 6 so that the front wall 12 of the lid 3 overlaps the inner front wall 26 of the container 2 along its entire width when the lid 3 is in its closed position. This reduces the gap through which contaminants can pass from outside of the package 1 into the delivery system receiving space 4.

It will be appreciated that in alternative embodiments, the shape, size, and positioning of the recess 32 in the inner frame 24 of the container 2 may vary. For example, the recess 32 may be a shape other than rectangular and may extend in a different wall of the inner frame 24 or in more than one wall.

The inner frame 24 of the container 2 may be a separate part of the package 1 to the outer frame 23 of the container 2. The inner frame 24 may be held in place in the outer frame 23 of the container 2 by, for example, but not limited to, glue. Alternatively, the outer and inner frames 23, 24 may be integrally formed.

Figure 2:
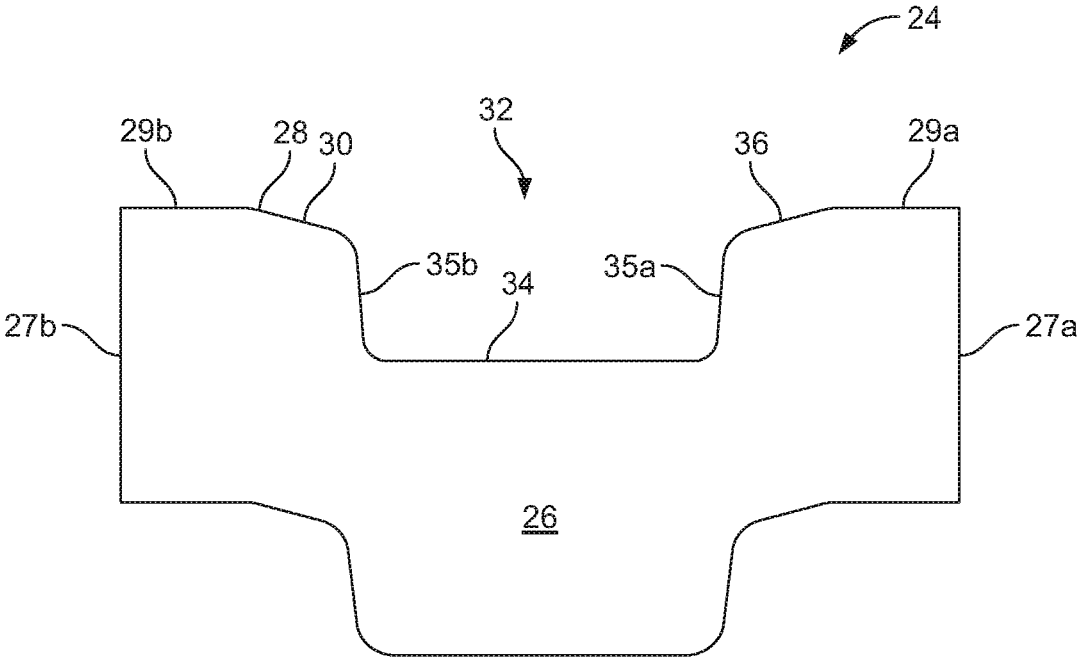
FIG. 2 shows a blank for forming an inner frame of the package shown in FIG. 1.

The inner frame 24 may comprise one side wall or two opposing side walls. A side wall 27*a*, 27*b* of the inner frame 24 comprises a portion which extends from the container 2 and which is received in the lid 3 when the lid 3 is closed. At least one of the side walls 27*a*, 27*b* of the inner frame 24 comprises at least two regions, which are not shown in FIG. 1 or FIG. 2. Examples of the regions are shown in FIGS. 3 to 8 and described in more detail hereinafter. The at least two regions have different coefficients of friction. The at least two regions include a first region and a second region. The first region has a lower coefficient of friction that the second region.

In this application the term coefficient of friction may be taken to mean the value of frictional force between each region and a specified surface. In one embodiment, the coefficient of friction is given between each region and the surface of the second region. The coefficient of friction may be given as static friction or dynamic friction.

Referring now to FIG. 3, a side view of a package 1 having an inner frame 40 according to the present disclosure is shown. The inner frame 40 shown in FIG. 3 is generally the same as the inner frame 24 described above in relation to FIGS. 1 and 2 and so a detailed description will be omitted herein. Furthermore, features and components of the inner frame 40 that are the same as the features and components of the above described inner frame 24 will retain the same terminology and reference numerals.

FIG. 3 shows the inner frame 40 which has a portion 40*a* that extends from the container 2. More specifically, FIG. 3 shows a portion of a side wall 27*a* of the inner frame 40 which extends from the container 2 and the lid 3 of the package 1 in a position in which it is being rotated from an open position towards a closed position about the hinge line 5.

The lid 3 of the package 1 may be considered to be in an open position when the lower edge 22 of the lid 3 has been rotated far enough away from the upper edge 25 of the outer frame 23 of the container 2 for a smoking article (not shown) to be removed from the receiving space 4 of the package 1. The package 1 may be considered to be in a closed position when the lower edge 22 of the lid 3 contacts or is proximate to the upper edge 25 of the outer frame 23 of the container 2. When the lid 3 is in its closed position a smoking article cannot be removed from the receiving space 4.

The side wall 27*a* of the inner frame 40 comprises at least two regions having different coefficients of friction. The at least two regions include a first region 41 and a second region 42. The first region 41 has a lower coefficient of friction than the second region 42. In the present embodiment, the at least two regions are discrete regions.

However, it will be appreciated that in an alternative embodiment, the at least two regions may not be discretely defined and instead a first region having a first coefficient of friction may gradually change into a second region having a second coefficient of friction. That is, the coefficient of friction may change gradually from a first region to a second region. The change may be gradual or may be formed by many small regions between the first region and the second region having increasing coefficients of friction.

The at least two regions 41, 42 which have different coefficients of friction are arranged on the side wall 27*a* of the inner frame 24 such that when the lid 3 is moved from an open position towards a closed position, the lid 3 is moved into contact with the first region 41 of the side wall 27*a* before being moved into contact with the second region 42 of the side wall 27*a*.

For example, as shown in FIG. 3, it can be seen that the lid 3 has been rotated from an open position towards a closed position and in doing so the lid 3 has already partially covered the side wall 27*a* of the inner frame 40. In doing so, the lid 3 has come into contact with the first region 41 of the side wall 27*a* of the inner frame 40 but has not yet come into contact with the second region 42 of the side wall 27*a* of the inner frame 40. However, upon further movement of the lid 3 about the hinge line 5 towards the closed position, it is clear that the lid 3 will come into contact with the second region 42 of the side wall 27*a*.

In the present embodiment, the first region 41 is located proximate to the upper edge 30 of the inner frame 40 and the second region 42 is located distal to the upper edge 30 of the inner frame 40. That is, the first region 41 is located closer to the upper edge 30 of the inner frame 40 than the second region 42.

More specifically, in the present embodiment, the first region 41 is located on an upper part 43 of the side wall 27*a* of the inner frame 40 that extends from the container 2 and the second region 42 is located on a lower part 44 of the side wall 27*a* of the inner frame 40 that extends from the container 2. That is, the first region 41 is located above the second region 42.

As illustrated in FIG. 3, the side wall 27*a* of the inner frame 40 comprises a front wall edge 46. The front wall edge 46 is the edge of the side wall 27*a* which connects the side wall 27*a* to the front wall 26 of the inner frame 40. The front wall edge 46 is located proximate to the front wall 6 of the container 2. The side wall 27*a* further comprises a rear edge 47. The rear edge 47 is the edge of the side wall 27*a* which is distal to the front wall 26 of the inner frame 40 and, in the present embodiment, is located opposite to the front wall edge 46. The rear edge 47 is located proximate to the rear wall 7 of the container 2.

In the embodiment shown in FIG. 3 it can be seen that at least one of the regions 41, 42 extend from the front wall edge 46 of the side wall 27*a* towards the rear edge 47 of the side wall 27*a* of the inner frame 40. In fact, in this embodiment, both the first region 41 and the second region 42 extend from the front wall edge 46 towards the rear edge 47. In an alternative embodiment, it may be that only one of the first and second regions 41, 42 extend from the front wall edge 46 of the side wall 27*a* towards the rear edge 47 of the side wall 27*a* of the inner frame 40.

It will be appreciated that at least one of the regions 41, 42 may extend fully across the portion of side wall 27*a* which extends from the container 2 between the front wall edge 46 towards the rear edge 47 of the inner frame 40. In the present embodiment, both the first region 41 and the second region 42 extend fully across the side wall 27*a* from the front wall edge 46 to the rear edge 47. In an alternative embodiment, it may be that only one of the first and second regions 41, 42 extends fully across the portion of the side wall 27*a* that extends from the container 2 from the front wall edge 46 of the side wall 27*a* to the rear edge 47 of the side wall 27*a* of the inner frame 40. It will be understood that in alternative embodiments the regions 41, 42 may extend only partially across the width of the side wall 27*a* of the inner frame 40.

In embodiments where the regions are discrete, each of the regions 41, 42 comprise peripheral edges 48, 49 which delimit the regions 41, 42. It will be understood that in embodiments where the regions are not discrete, but instead a gradual change occurs, it may be difficult to define peripheral edges between regions. However, in some embodiment, regions may be defined as being within a range of coefficients of friction. In other embodiments, the gradual change of the coefficient of friction may be provided by infinite infinitely small regions.

The first region 41 is defined by peripheral edges 48 including a top peripheral edge 48*a* and opposing bottom peripheral edge 48*b* as well as a front peripheral edge 48*c* and an opposing rear peripheral edge 48*d*. The peripheral edges 48 of the first region 41 also includes a sloped peripheral edge 48*e* where the side wall 8*a* of the container 2 overlaps the side wall 27*a* of the inner frame 40. In some embodiments, the first region 41 may extend across the portion of the inner frame 40 that is overlapped by the side wall 8*a* of the container 2, such that the first region does not have a sloped peripheral edge 48*e*.

The second region 42 is defined by peripheral edges 49 including a top peripheral edge 49*a* and opposing bottom peripheral edge 49*b* as well as a front peripheral edge 49*c*. Due to the positioning of the second region 42 and the side wall 8*a* of the container 2 overlapping the second region 42 of the inner frame 40, the second region 42 comprises a rear sloped peripheral edge 49*e*. In some embodiments, the first region 42 may extend across the portion of the inner frame 40 that is overlapped by the side wall 8*a* of the container 2, such that the second region does not have a sloped rear peripheral edge 49*e* but a vertically extending rear peripheral edge similar to the rear peripheral edge 48*d* of the first region 41.

The top peripheral edge 48*a* of the first region 41 may be in line with the upper edge 29*a* of the side wall 27*a* of the inner frame 40. The front peripheral edges 48*c*, 49*c* may be in line with the front wall edge 46 of the side wall 27*a* of the inner frame 40. The rear peripheral edges 48*d* of the first and second regions 41, 42 may be in line with the rear edge 47 of the side wall 27*a* of the inner frame 40.

It will be understood that in an alternative embodiment, the regions 41, 42 may have any shape and the peripheral edges 48, 49 may be configured to realize the required shape, size, and location of the regions 41, 42.

In the present embodiment, at least one of the peripheral edges 48, 49 of each region 41, 42 extends parallel to the bottom wall 9 of the container 2. That is, at least one of the peripheral edges 48, 49 of the first and second regions 41, 42 extend horizontally. As shown in FIG. 3, the top and bottom peripheral edges 48*a*, 48*b* of the first region 41 and the top and bottom peripheral edges 49*a*, 49*b* of the second region 42 extend horizontally and parallel to the bottom wall 9 of the container 2 and each other. The bottom peripheral edge 48*b* of the first region and the top peripheral edge 49*a* of the second region 42 abut along their length. Thus, the first and second regions 41, 42 extend horizontally and parallel across the side wall 27*a* of the inner frame 40.

At least one of the regions 41, 42 on the side wall 27*a* of the inner frame 40 may be formed by a coating on the side wall 27*a* of the inner frame 40. The coating may be formed from, for example, but not limited to, structured varnish or structured ink or soft touch varnish or soft touch ink. Examples of a structured varnish or ink that may be used are tactile inks, such as 10-602335-1 WB TOB PV, or soft touch inks, such as 10-604644-4 WB TOB OPV. A different coating may be used for each region 41, 42 in order to obtain regions 41, 42 having different coefficients of friction.

In the present embodiment, the second region 42 has a coating which has a coefficient of friction which is greater than the coefficient of friction of the side wall 27*a* of the inner frame 40. Therefore, the friction between the second region 42 of the side wall 27*a* of the inner frame 40 and an inner surface of the lid 3 is increased when the lid 3 is in the closed position. The increase in friction between the second region 42 of the inner frame 40 and the lid 3 helps to keep the lid 3 in the closed position so that the package 1 is closed more securely, does not suffer from yawning, and helps to prevent contaminants from entering the receiving space 4 of the package 1.

In the present embodiment, the first region 41 has a coating which has a coefficient of friction which is less than the coefficient of friction of the side wall 27*a* of the inner frame 40. Therefore, the friction between the first region 41 of the side wall 27*a* of the inner frame 40 and an inner surface of the lid 3 is reduced when the lid 3 is initially moved from an open position towards the closed position. Therefore, a consumer does not have to apply as large a force to the lid 3 when initially moving the lid 3 from an open position towards a closed position.

Therefore, when moving the lid 3 into its closed position, the consumer will feel an increase in the force needed to close the lid 3 when the lid 3 comes into contact with the second region 42 of the inner frame 40 as the lid 3 is rotated about the hinge lid 5. The increased force required to overcome the increase in friction makes the consumer aware that the lid 3 is almost in its closed position.

However, in an alternative embodiment, the first region 41 may not have a coating and instead may be formed by the material which forms the side wall 27*a* of the inner frame 40 such that the first region 41 has the same coefficient of friction as the inner frame 40.

It will be appreciated that the various arrangements of the first and second regions 41, 42 on the side wall 27*a* of the inner frame 40 as described above may be present on both side walls 27*a*, 27*b* of the inner frame 40 or on only one of the side walls 27*a*, 27*b* of the inner frame 40.

In one embodiment, an inner surface of the side wall 14*a* of the lid 3 may comprise at least two regions having different coefficients of friction including a first region 41 and a second region 42. The first region on the lid 3 may overlap the first region 41 on the inner frame 40 and the second region on the lid 3 may overlap the second region 42 on the inner frame 40 when the lid 3 is in its closed position.

Figure 4:
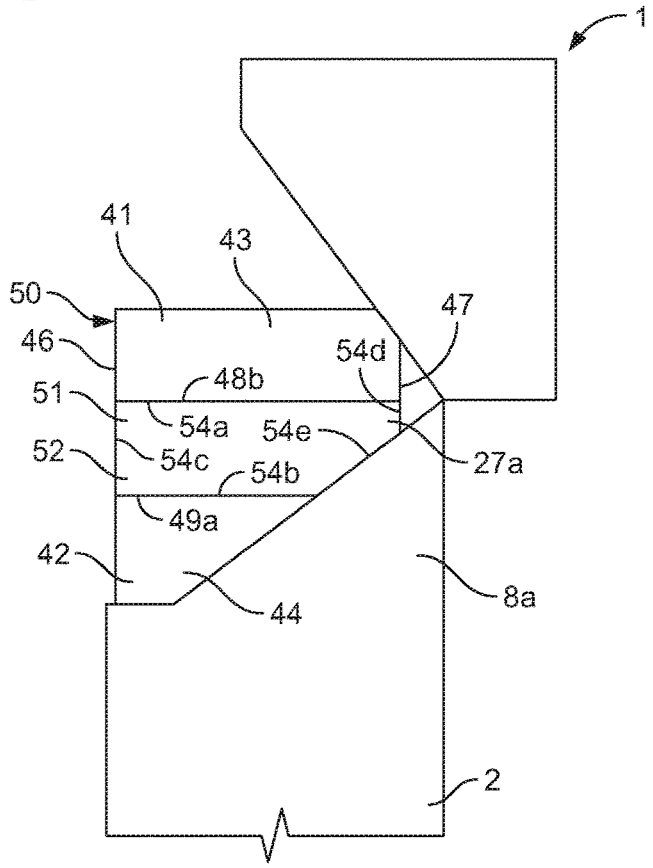
FIG. 4 shows a side view of another embodiment of the present disclosure.

Referring now to FIG. 4, a side view of a package 1 having an inner frame 50 according to the present disclosure is shown. The inner frame 50 shown in FIG. 4 is generally the same as the inner frame 40 described above in relation to FIG. 3 and so a detailed description will be omitted herein. Furthermore, features and components of the inner frame 50 that are the same as the features and components of the above described inner frame 40 will retain the same terminology and reference numerals.

The difference between the inner frame 40 shown in FIG. 3 and the inner frame shown in FIG. 4 is that the inner frame 50 shown in FIG. 4 further comprises a third region 51. The third region 51 has a different coefficient of friction to the first region 41 and the second region 42. The third region 51 is located between the first and second regions 41, 42 on the side wall 27*a* of the inner frame 40. That is, the third region 51 is located on a middle part 52 of the side wall 27*a* with the first region 41 located on the upper part 43 above the third region 51 and the second region 42 located on the lower part 44 of below the third region 51.

The third region 51 extends from the front wall edge 46 of the side wall 27*a* towards the rear edge 47 of the side wall 27*a* of the inner frame 50. In the present embodiment, the third region 51 extends fully across the portion of side wall 27*a* which extends from the container 2 between the front wall edge 46 towards the rear edge 47 of the inner frame 50. However, it will be understood that in alternative embodiments the third region 51 may extend only partially across the width of the side wall 27*a* of the inner frame 50.

In the embodiment illustrated in FIG. 4 the regions are shown as discrete regions. The third region 51 comprises peripheral edges 54 which delimit the third region 54. The third region 54 is defined by peripheral edges 54 including a top peripheral edge 54*a* and opposing bottom peripheral edge 54*b* as well as a front peripheral edge 54*c* and an opposing rear peripheral edge 54*d*. The peripheral edges 54 of the third region 41 also includes a sloped peripheral edge 54*e* where the side wall 8*a* of the container 2 overlaps the side wall 27*a* of the inner frame 50. In some embodiments, the third region 51 may extend across the portion of the inner frame 50 that is overlapped by the side wall 8*a* of the container 2, such that the third region 51 does not have a sloped peripheral edge 54*e*.

The top peripheral edge 54*a* of the third region 51 may be in line with the bottom peripheral edge 48*b* of the first region 41. The bottom peripheral edge 54*b* of the third region 51 may be in line with the top peripheral edge 49*a* of the second region 42. The front peripheral edges 54*c* may be in line with the front wall edge 46 of the side wall 27*a* of the inner frame 50. The rear peripheral edge 54*d* of the third region 51 may be in line with the rear edge 47 of the side wall 27*a* of the inner frame 50.

At least one of the peripheral edges of each region extends parallel to the bottom wall 9 of the container 2. That is, at least one of the peripheral edges 48, 49, 54 of the first, second, and third regions 41, 42, 51 extend horizontally. In the present embodiment, the top and bottom peripheral edges 48*a*, 48*b* of the first region 41, the top and bottom peripheral edges 49*a*, 49*b* of the second region 42 and the top and bottom peripheral edges 54*a*, 54*b* of the third region 51 extend horizontally and parallel to the bottom wall 9 of the container 2 and each other. Thus, the first, second, and third regions 41, 42, 54 extend horizontally and parallel across the width of the side wall 27*a* of the inner frame 50.

The third region 51 may have a coating that has a coefficient of friction which is greater than or less than the coefficient of friction of the material which forms the side wall 27*a* of the inner frame 50. Preferably, the third region 51 has a coefficient of friction which is greater than the coefficient of friction of the first region 41. In some embodiments, the third region 51 has a coefficient of friction which is less than the coefficient of friction of the second region 42. That is, during movement of the lid 3 from its open position to its closed position, the lid 3 can come into contact firstly with the region which has the lowest coefficient of friction and finally with the region which has the highest coefficient of friction. In some embodiment, the third region 51 may be formed by the side wall 27*a* of the inner frame 50.

Figure 5:
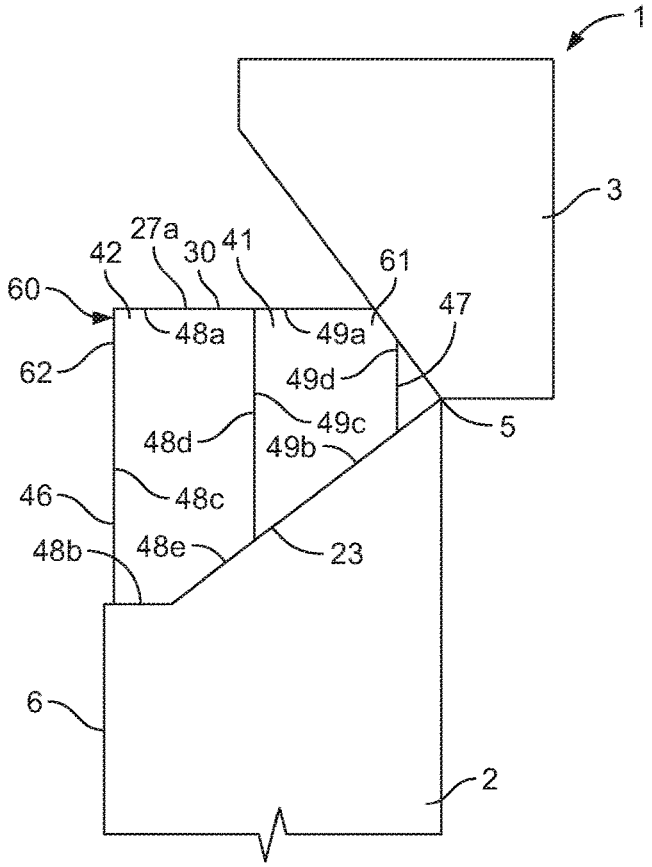
FIG. 5 shows aside view of a further embodiment of the present disclosure.

Referring now to FIG. 5, a side view of a package 1 having an inner frame 60 according to the present disclosure is shown. The inner frame 60 shown in FIG. 5 is generally the same as the inner frame 40 described above in relation to FIG. 3 and so a detailed description will be omitted herein. Furthermore, features and components of the inner frame 60 that are the same as the features and components of the above described inner frame 40 will retain the same terminology and reference numerals.

The difference between the inner frame 40 shown in FIG. 3 and the inner frame 60 shown in FIG. 5 is that the configuration of the first and second regions 41, 42 on the side wall 27*a* of the inner frame 60.

As illustrated in FIG. 5, the lid 3 has been rotated from an open position towards a closed position and in doing so the lid 3 has already partially covered the side wall 27*a* of the inner frame 60. In doing so, the lid 3 has come into contact with the first region 41 of the side wall 27*a* of the inner frame 60 but has not yet come into contact with the second region 42 of the side wall 27*a* of the inner frame 60. However, upon further movement of the lid 3 about the hinge line 5 towards the closed position, it is clear that the lid 3 will come into contact with the second region 42 of the side wall 27*a*.

In the present embodiment, the first region 41 is located proximate to the rear edge 47 of the inner frame 60 and the second region 42 is located proximate to the front wall edge 46 of the inner frame 60, i.e. distal to the rear edge 47. That is, the second region 42 is located closer to the front wall 6 of the container 2 than the first region 41.

More specifically, in the present embodiment, the first region 41 is located on a rear part 61 of the side wall 27*a* of the inner frame 60 that extends from the container 2 and the second region 42 is located on a front part 62 of the side wall 27*a* of the inner frame 60 that extends from the container 2. That is, the second region 42 is located in front of the first region 41.

In the embodiment shown in FIG. 5 it can be seen that at least one of the regions 41, 42 extends from the point at which the inner frame 60 extends beyond the upper edge 23 of the container 2 towards the upper edge 30 of the inner frame 60. In fact, in this embodiment, both the first region 41 and the second region 42 extend from the upper edge 23 of the container 2 towards the upper edge 30 of the inner frame 60. In an alternative embodiment, it may be that only one of the first and second regions 41, 42 extend from the upper edge 23 of the container 2 towards the upper edge 30 of the inner frame 60.

It will be appreciated that at least one of the regions 41, 42 may extend fully along the length of the portion of side wall 27*a* which extends from the container 2 between the upper edge 23 of the container 2 and the upper edge 30 of the inner frame 60. In the present embodiment, both the first region 41 and the second region 42 extend fully along the length of the side wall 27*a* from the upper edge 23 of the container 2 to the upper edge 30 of the inner frame 60.

In an alternative embodiment, it may be that only one of the first and second regions 41, 42 extends fully along the length of the portion of the side wall 27*a* that extends from the container 2 from the upper edge 23 of the container 2 to the upper edge 30 of the inner frame 60. It will be understood that in alternative embodiments the regions 41, 42 may extend only partially along the length of the side wall 27*a* of the inner frame 60.

In the embodiment illustrated in FIG. 5 the regions are shown as discrete regions. The first region 41 is defined by peripheral edges 48 including a top peripheral edge 48*a* and opposing bottom peripheral edge 48*b* as well as a front peripheral edge 48*c* and an opposing rear peripheral edge 48*d*. The peripheral edges 48 of the first region 41 also includes a sloped peripheral edge 48*e* where the side wall 8*a* of the container 2 overlaps the side wall 27*a* of the inner frame 40.

The second region 42 is defined by peripheral edges 49 including a top peripheral edge 49*a* and opposing sloped bottom peripheral edge 49*b* as well as a front peripheral edge 49*c* and a rear peripheral edge 49*d*.

The top peripheral edge 48*a*, 49*b* of the first and second regions 41, 42 may be in line with the upper edge 29*a* of the side wall 27*a* of the inner frame 60. The rear peripheral edges 49*d* of the first region 41 may be in line with the rear edge 47 of the side wall 27*a* of the inner frame 60. The front wall edge 49*c* of the second region 42 may be in line with the front wall edge 46 of the side wall 27*a* of the inner frame 60.

In the present embodiment, at least one of the peripheral edges 48, 49 of each region 41, 42 extends parallel to the front wall 6 of the container 2. That is, at least one of the peripheral edges 48, 49 of the first and second regions 41, 42 extend vertically. As shown in FIG. 5, the front and rear peripheral edges 48*c*, 48*d* of the first region 41 and the front and rear peripheral edges 49*c*, 49*d* of the second region 42 extend vertically and parallel to the front wall 6 of the container 2 and each other. The front peripheral edge 48*c* of the first region 41 and the rear peripheral edge 49*d* of the second region 42 abut along their length. Thus, the first and second regions 41, 42 extend vertically and parallel along the length of the side wall 27*a* of the inner frame 60.

In the present embodiment, the second region 42 has a coating which has a coefficient of friction which is greater than the coefficient of friction of the side wall 27*a* of the inner frame 60. The increase in friction between the second region 42 of the inner frame 60 and the lid 3 helps to keep the lid 3 in the closed position so that the package 1 is closed more securely and helps to prevent contaminants from entering the receiving space 4 of the package 1.

The first region 41 may have a coating which has a coefficient of friction which is less than the coefficient of friction of the side wall 27*a* of the inner frame 60. Therefore, a consumer does not have to apply as large a force to the lid 3 when initially moving the lid 3 from an open position towards a closed position.

In the present embodiment, when a consumer moves the lid 3 towards its closed position, the consumer will feel an increase in the force needed to close the lid 3 when the lid 3 comes into contact with the second region 42 of the inner frame 60 as the lid 3 is rotated about the hinge lid 5. As the lid 3 comes into contact with a larger amount of the second region during closing the force needed to overcome the frictional force will increase proportionally. The increased force required to overcome the increase in friction makes the consumer aware that the lid 3 is almost in its closed position.

However, in an alternative embodiment, the first region 41 may not have a coating and instead may be formed by the material which forms the side wall 27*a* of the inner frame 60 such that the first region 41 has the same coefficient of friction as the inner frame 60.

Figure 6:
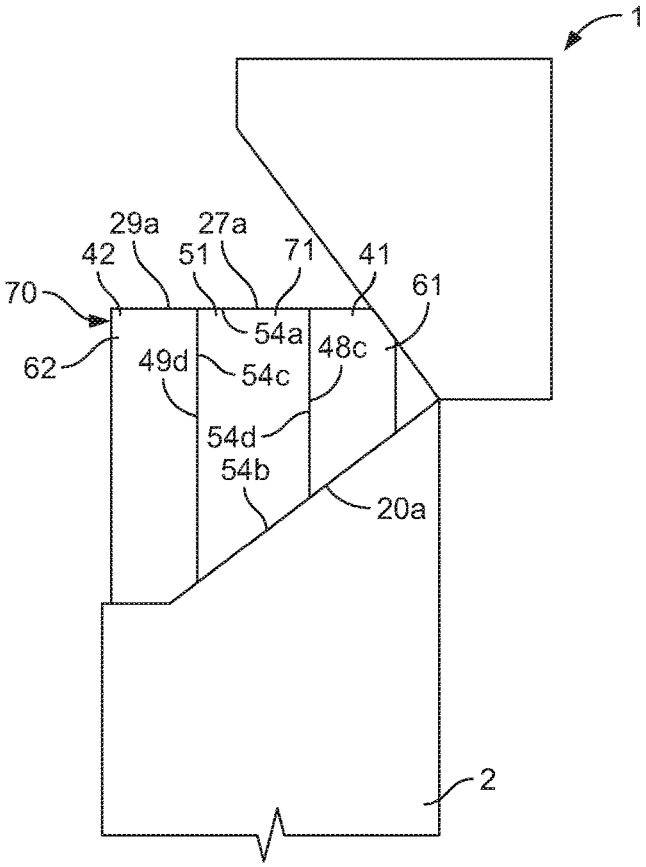
FIG. 6 shows aside view of a further embodiment of the present disclosure.

Referring now to FIG. 6, a side view of a package 1 having an inner frame 70 according to the present disclosure is shown. The inner frame 70 shown in FIG. 6 is generally the same as the inner frame 60 described above in relation to FIG. 5 and so a detailed description will be omitted herein. Furthermore, features and components of the inner frame 70 that are the same as the features and components of the above described inner frame 60 will retain the same terminology and reference numerals.

The difference between the inner frame 40 shown in FIG. 5 and the inner frame 70 shown in FIG. 6 is that the inner frame 70 shown in FIG. 6 comprises a third region 51. The third region 51 has a different coefficient of friction to the first region 41 and the second region 42. The third region 51 is located between the first and second regions 41, 42 on the side wall 27*a* of the inner frame 70. That is, the third region 51 is located on a middle part 71 of the side wall 27*a* with the first region 41 located on the rear part 61 behind the third region 51 and the second region 42 located on the front part 62 of the inner frame 27*a* in front of the third region 51.

The third region 51 extends from the upper edge 23 of the container 2 towards the upper edge 29*a* of the side wall 27*a* of the inner frame 70. In the present embodiment, the third region 51 extends fully along the length of the portion of side wall 27*a* which extends from the container 2. However, it will be understood that in alternative embodiments the third region 51 may extend only partially along the length of the side wall 27*a* of the inner frame 70.

In the embodiment illustrated in FIG. 6 the regions are shown as discrete regions. The third region 51 comprises peripheral edges 54 which delimit the third region 54. The third region 54 is defined by peripheral edges 54 including a top peripheral edge 54*a* and opposing sloped bottom peripheral edge 54*b* as well as a front peripheral edge 54*c* and an opposing rear peripheral edge 54*d*.

The top peripheral edge 54*a* of the third region 51 may be in line with the upper edge 29*a* of the side wall 27*a* of the inner frame 70. The sloped bottom peripheral edge 54*b* of the third region 51 may be in line with the upper edge 20*a* of the side wall 8*a* of the container 2. The front peripheral edge 54*c* of the third region 54 may be in line with the rear peripheral edge 49*d* of the second region 42. The rear peripheral edge 54*d* of the third region 51 may be in line with the front peripheral edge 48*c* of the first region 41.

At least one of the peripheral edges of each region extends parallel to the front wall 6 of the container 2. That is, at least one of the peripheral edges 48, 49, 54 of the first, second, and third regions 41, 42, 51 extend vertically. In the present embodiment, the front and rear peripheral edges 48*c*, 48*d* of the first region 41, the front and rear peripheral edges 49*c*, 49*d* of the second region 42 and the front and rear peripheral edges 54*c*, 54*d* of the third region 51 extend vertically and parallel to the front wall 6 of the container 2 and each other. Thus, the first, second, and third regions 41, 42, 54 extend vertically and parallel along the length of the side wall 27*a* of the inner frame 70.

The third region 51 may have a coating that has a coefficient of friction which is greater than or less than the coefficient of friction of the material which forms the side wall 27*a* of the inner frame 50. In some embodiments, the third region 51 has a coefficient of friction which is greater than the coefficient of friction of the first region 41 and which is less than the coefficient of friction of the second region 42. In some embodiments, the third region 51 may be formed by the side wall 27*a* of the inner frame 50.

Figure 7:
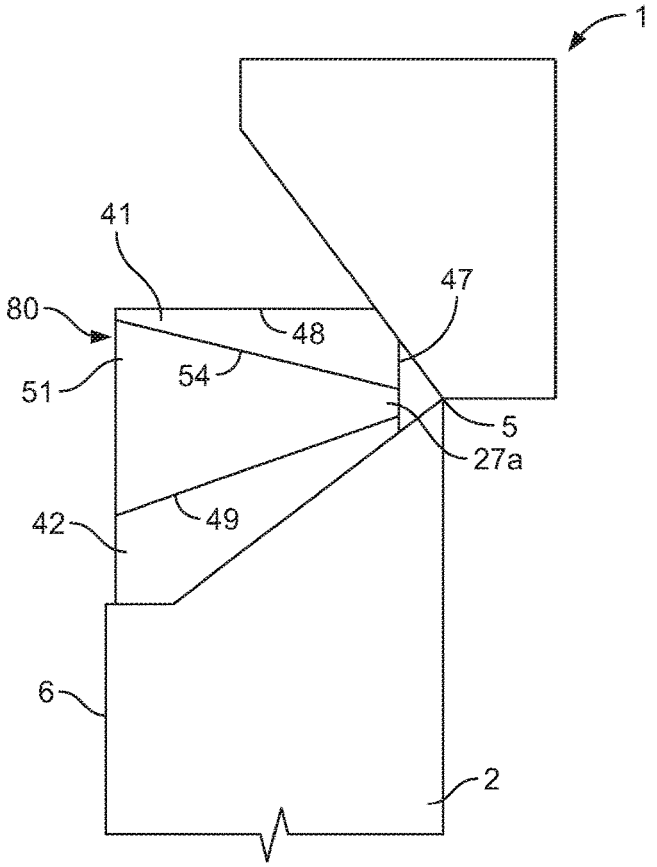
FIG. 7 shows aside view of a further embodiment of the present disclosure.

Referring now to FIG. 7, a side view of a package 1 having an inner frame 80 according to the present disclosure is shown. The inner frame 80 shown in FIG. 7 is generally the same as the inner frame 40 described above in relation to FIG. 3 and so a detailed description will be omitted herein. Furthermore, features and components of the inner frame 80 that are the same as the features and components of the above described inner frame 40 will retain the same terminology and reference numerals.

In FIG. 7, the side wall 27*a* of the inner frame 80 comprises three regions 41, 42, 54. In the embodiment illustrated in FIG. 4 the regions are shown as discrete regions. The regions are delimited by peripheral edges 48, 49, 54. In the embodiment shown in FIG. 7, at least one of the peripheral edges of each region extends at an angle to the front wall 6 of the container and the bottom wall 9 of the container 2. That is, at least one of the peripheral edges of each of the regions extends neither horizontally or vertically. Instead, the peripheral edges of the regions diverge from the rear edge 47 of the side wall 27*a* of the inner frame 80 towards the front wall edge 46. In some embodiments, the diverging peripheral edges are arranged such that they share a common point of origin. Preferably, the point of origin of the converging peripheral edges is located on the axis that extends along the hinge line 5.

Figure 8:
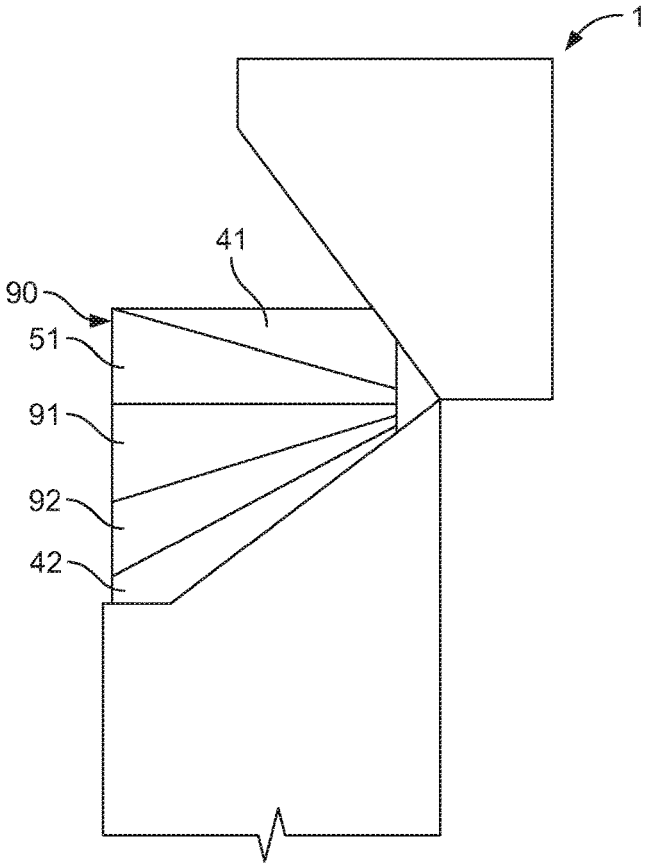
FIG. 8 shows aside view of a further embodiment of the present disclosure .

Referring now to FIG. 8, a side view of a package 1 having an inner frame 90 according to the present disclosure is shown. The inner frame 90 shown in FIG. 8 is generally the same as the inner frame 70 described above in relation to FIG. 7 and so a detailed description will be omitted herein. Furthermore, features and components of the inner frame 90 that are the same as the features and components of the above described inner frame 80 will retain the same terminology and reference numerals.

In FIG. 8, the side wall 27*a* of the inner frame 80 further comprises a fourth region 91 and a fifth region 92 instead of the three regions 41, 42, 54 shown in the embodiment in FIG. 7. In the present embodiment, at least one of the peripheral edges of at least one of the regions extends horizontally. It will be understood that in an alternative embodiment, the number of regions may vary. Furthermore, instead of being discrete regions, the coefficient of friction may change gradually between the regions.

The embodiments of the package may comprise a pair of ears, which are not shown in the drawings but are well known in the art. The pair of ears extend outwardly sideways from the container side walls 8*a*, 8*b*. Each ear extends perpendicularly from the container side walls 8*a*, 8*b* parallel to and from the container front wall 6. Each ear is formed by means of a cut line formed in the container side walls 8*a*, 8*b*. An advantage of the package having ears if that the ears are able to be disposed to extend from the container side walls to help retain the lid 3 in the closed position. In some embodiments, the ears may also comprise one or more of the regions of different coefficients of friction depending on the configuration of the package. The coatings may be applied to the ears before they are cut from the blank.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of the claimed invention. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claims, but which may be claimed in future.

The invention claimed is:

1. A package for one or more delivery systems, the package comprising:

a container;

a lid hingedly connected to the container about a hinge line; and an inner frame comprising a side wall having a portion which extends from the container and which is received in the lid when the lid is closed, wherein the portion of the side wall extending from the container comprises at least two regions having different coefficients of friction, and wherein the lid has a side panel that overlaps a corresponding side wall of the inner frame when the lid is closed, and the at least two regions comprise at least a first region and a second region, and wherein the first region has a lower coefficient of friction than the second region, the at least two regions of the side wall being arranged such that when the lid is rotated towards a closed position, the side panel of the lid slides against the first region of the corresponding side wall before sliding against the second region of the corresponding side wall, and further comprising at least a third region on the inner frame having a different coefficient of friction than the first region and the second region, the third region being located between the first region and the second region.

2. The package according to claim 1, wherein the inner frame comprises an upper edge, and wherein the first region is located proximate to the upper edge of the inner frame and the second region is located distal to the upper edge of the inner frame.

3. The package according to claim 2, wherein the first region is located on an upper part of the side wall of the inner frame and the second region is located on a lower part of the side wall of the inner frame.

4. The package according to claim 1, wherein the side wall of the inner frame comprises a front wall edge and a rear edge, and wherein at least one of the at least two regions extends from the front wall edge of the side wall towards the rear edge.

5. The package according to claim 4, wherein at least one of the at least two regions extends fully across a width of the portion of the side wall which extends from the container between the front wall edge and the rear edge of the side wall.

6. The package according to claim 1, wherein at least one of the at least two regions is discrete and comprises peripheral edges which delimit the respective region, and wherein a peripheral edge of at least one of the at least two regions extends parallel to a bottom wall of the container.

7. The package according to claim 6, wherein a peripheral edge of each of the at least two regions on the side wall extends parallel to the bottom wall of the container.

8. The package according to claim 7, wherein an upper peripheral edge and a lower peripheral edge of each of the at least two regions on the side wall extend parallel to the bottom wall of the container.

9. The package according to claim 1, wherein at least one of an upper peripheral edge or a lower peripheral edge of each of the at least two regions which delimit the regions on the inner frame extend radially from a point which originates at an axis extending along the hinge line.

10. The package according to claim 1, wherein the side wall of the inner frame comprises a front wall edge and a rear edge, and wherein the first region is located proximate to the rear edge of the side wall and the second region is located proximate to the front wall edge of the side wall.

11. The package according to claim 10, wherein the first region is located on a rearward part of the side wall of the inner frame and the second region is located on a forward part of the side wall of the inner frame.

12. The package according to claim 1, wherein the container comprises an upper edge and the inner frame comprises an upper edge, and wherein at least one of the at least two regions extends from the upper edge of the container towards the upper edge of the inner frame.

13. The package according to claim 12, wherein at least one of the at least two regions extends fully along a length of the portion of the side wall which extends from the container between the upper edge of the container and the upper edge of the inner frame.

14. The package according to claim 1, wherein at least one of the at least two regions is discrete and comprises peripheral edges which delimit the respective region, and wherein a peripheral edge of at least one of the at least two regions extends parallel to a front wall of the container.

15. The package according to claim 14, wherein a peripheral edge of each of the at least two regions extends parallel to the front wall of the container.

16. The package according to claim 15, wherein a front peripheral edge and a rear peripheral edge of each of the at least two regions extends parallel to the front wall of the container.

17. The package according to claim 1, wherein the coefficient of friction changes gradually between the at least two regions.

18. The package according to claim 1, wherein at least one of the at least two regions is formed by a coating on the side wall of the inner frame.

19. The package according to claim 18, wherein a second region is formed by a coating having a coefficient of friction greater than the coefficient of friction of the side wall of the inner frame.

20. The package according to claim 18, wherein a first region is formed by a coating having a coefficient of friction less than the coefficient of friction of the side wall of the inner frame.

21. The package according to claim 1, wherein the lid comprises at least two regions having different coefficients of friction, and wherein a first region on the lid overlaps the first region on the inner frame and a second region on the lid overlaps the second region on the inner frame when the lid is in a closed position.

* * * * *